United States Patent [19]

Rissman et al.

[11] Patent Number: 4,802,879

[45] Date of Patent: Feb. 7, 1989

[54] ACTION FIGURE TOY WITH GRAPHICS DISPLAY

[75] Inventors: Owen R. Rissman, Northbrook, Ill.; Henry T. H. Tai, Chaiwan, Hong Kong

[73] Assignee: Tiger Electronics, Inc., Vernon Hills, Ill.

[21] Appl. No.: 859,699

[22] Filed: May 5, 1986

[51] Int. Cl.[4] ..... A63H 3/16; A63H 3/28

[52] U.S. Cl. ..... 446/175; 446/101; 446/295; 446/297

[58] Field of Search ..... 446/101, 175, 295, 297, 446/302, 303, 321, 472, 487; 273/310, 311

[56] References Cited

U.S. PATENT DOCUMENTS

| | | | |
|---|---|---|---|
| D. 284,948 | 8/1986 | Ogawa | 446/487 |
| 1,649,135 | 11/1927 | Shasteen | 446/101 |
| 3,274,729 | 9/1966 | Refabert | 446/175 |
| 3,298,132 | 1/1967 | Elwell | 446/295 |
| 4,221,927 | 9/1980 | Dankman et al. | 446/175 |
| 4,231,184 | 11/1980 | Corris et al. | 446/175 |
| 4,267,551 | 5/1981 | Dankman et al. | 446/295 |
| 4,540,176 | 9/1985 | Baer | 446/302 |
| 4,585,424 | 4/1986 | DeMars | 446/295 |
| 4,601,668 | 7/1986 | Sirota | 446/472 |
| 4,642,710 | 2/1987 | Murtha et al. | 446/175 |

FOREIGN PATENT DOCUMENTS

| | | | |
|---|---|---|---|
| 2058589 | 4/1981 | United Kingdom | 446/175 |
| 2133712 | 8/1984 | United Kingdom | 446/101 |

*Primary Examiner*—Robert A. Hafer
*Assistant Examiner*—Charles H. Harris
*Attorney, Agent, or Firm*—Dressler, Goldsmih, Shore, Sutker & Milnamow, Ltd.

[57] ABSTRACT

An action figure toy construction is disclosed which has been configured to exhibit animate characteristics for enhanced entertainment for children. In particular, the present toy construction inludes a liquid crystal graphics display mounted on a humanoid torso portion of the action figure. Suitable micro-processor controls are provided which are operatively connected to the graphics display for controlling and regulating the graphic representation of a plurality of simulated life functions shown by the display, thus lending animation to the toy construction. Embodiments of the toy constructon may include interchangeable limbs for connection to the torso portion, as well as light and sound sensors, and light and sound generating devices.

10 Claims, 2 Drawing Sheets

ACTION FIGURE TOY WITH GRAPHICS DISPLAY

TECHNICAL FIELD

The present invention relates generally to a doll-like toy construction, and more particularly to a so-called "action figure" toy having a graphics display for showing a plurality of simulated life functions in different levels of activity, thus lending animated characteristics to the toy construction.

BACKGROUND OF THE INVENTION

So-called "action figure" toys have become increasingly popular with children in recent years. Toys of this nature are generally doll-like in configuration, and are frequently configured to resemble television or motion picture characters, either actual or fictional, as portrayed in both animated and filmed features. Since children frequently play with toys of this nature by engaging in mock combat and battles, expeditions, and other adventures, these types of toy constructions are generally referred to as "action" toys.

While toy constructions of this nature may be configured to resemble human beings, such figures may also be configured to appear as robots, or beings having combinations of humanoid and robotic characteristics. Such toys may be provided with accessory vehicles, mock weapons, and the like for enhanced entertainment, and in general have proven to be among the most popular of children's toys.

Although it is a child's imagination which generally gives "life" and animation to these types of toy figures, it will be appreciated that providing an action toy figure having animated characteristics enhances the entertainment and stimulation that these toys provide for children. Accordingly, the present invention contemplates an action figure toy construction configured to exhibit simulated life functions or other animated characteristics.

SUMMARY OF THE INVENTION

In accordance with the present invention, an action toy figure construction is disclosed which has been particularly configured to exhibit animated characteristics for enhanced enjoyment by children. In particular, the toy construction is provided with a graphics display which exhibits simulated life functions, with a micro-processor control unit provided for varying the levels of activity of the different life functions in response to different control inputs.

In the illustrated embodiment, the present action toy figure comprises a humanoid torso portion configured to generally resemble a human torso, with a graphics display, comprising a liquid crystal display, mounted on the torso portion. The graphics display is configured to display a plurality of simulated life functions, and to show such life functions in a plurality of differing levels of activity. In the preferred form, a "beating" heart, circulating "blood", an energy level indicator, and other sequentially changing indicia are provided to lend animated characteristics to the toy construction.

Control and regulation of the graphics display is effected by a suitable micro-processor preferably mounted within the torso portion. At least one selectively operable switch means is preferably provided on the torso portion, with the switch means operably connected to the micro-processor whereby selective operation of the switch means effect operation of the graphics display. In the presently preferred form, operation of the switch means acts to alter the level of activity of the simulated life functions shown by the graphics display.

A number of additional features are provided in the preferred embodiment. The toy construction is preferably configured such that a humanoid head portion is joined to the torso portion, with a pair of light-emitting diodes positioned in the head portion to represent "eyes" for the action figure. The light-emitting diodes are operatively connected with the micro-processor whereby the diodes are operated in coordination with changes in the level of activity of the life functions shown by the graphics display. A suitable sound generator is also preferably provided, and is operatively connected with the micro-processor. In this manner, sound can be generated in coordination with operation of the graphics display and the features displayed thereby, thus further lending to the animated characteristics of the construction.

In order to enhance a child's entertainment when playing with the present toy, the construction is preferably arranged to promote interaction with another like toy. To this end, a light-sensor is preferably provided which is operatively connected to the micro-processor, with the light-sensor acting to effect operation of the graphics display responsively to light signals received by the sensor. It is presently contemplated that the light-sensor respond to predetermined light signals provided by a mock weapon (i.e., a "ray gun" or "laser beam gun") compatible with the device.

Numerous other features and advantages of the present invention will become readily apparent from the following detailed description, the accompanying drawings, and the appended claims.

DETAILED DESCRIPTION

Figure 1:
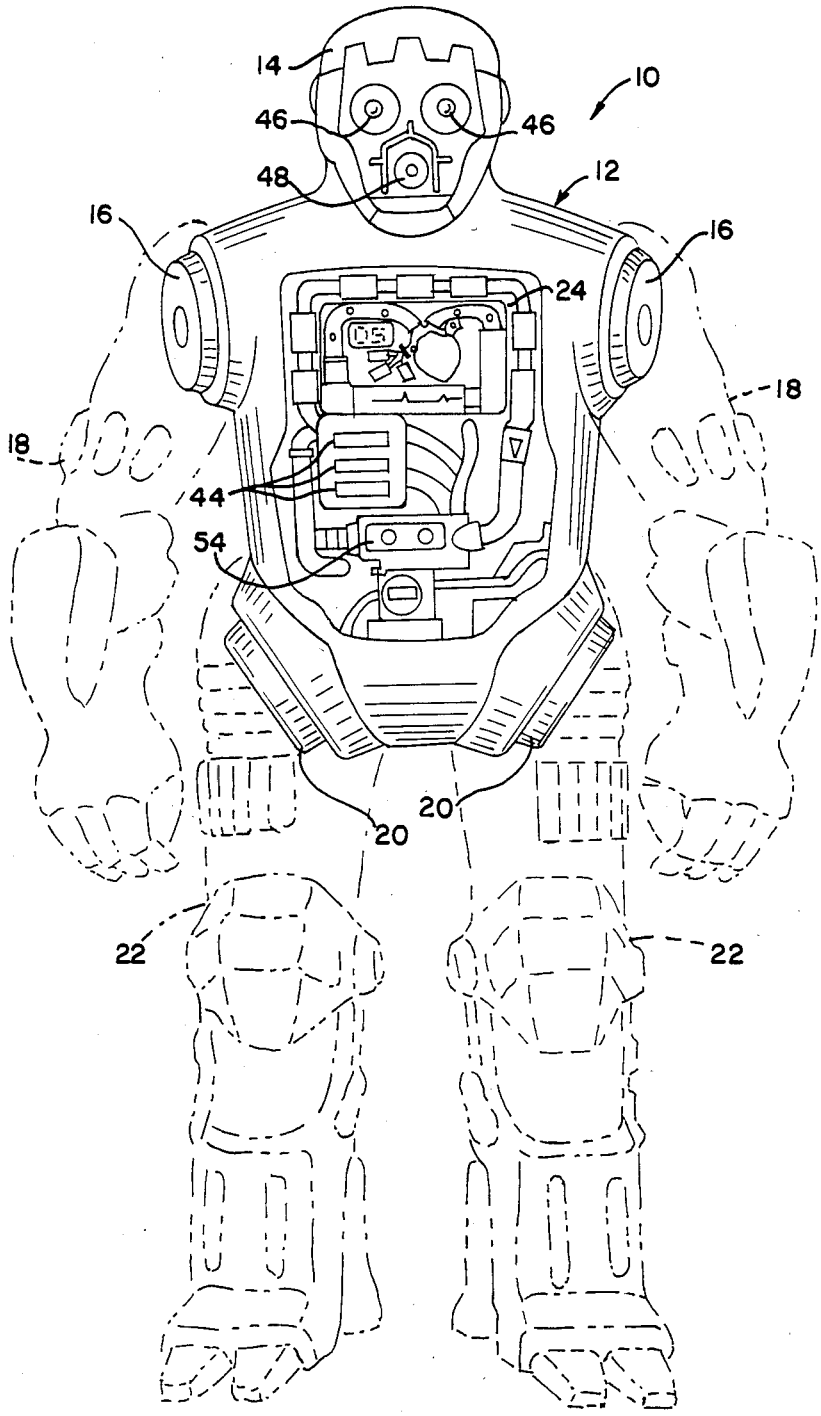
FIG. 1 is a front elevational view of an action figure toy construction having a graphics display embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring first to FIG. 1, therein is disclosed an action figure toy construction 10 embodying the principles of the present invention. As is evident, the illustrated embodiment is shown to have a generally human-like form, and therefore will be referred to as having humanoid characteristics. For purposes of the present disclosure, it is to be understood that reference to human-like and humanoid characteristics is intended to encompass both human and non-human (i.e., robotic-like) features; thus a toy figure in accordance with the present invention may be provided in an almost endless variety of particular shapes, forms, colors, etc.

In keeping with an adventure-oriented theme for the present construction, the toy FIG. 10 may be configured to resemble a warrior or soldier-like being, as shown. Thus, the construction may be arranged to include "armor", and may be provided with mock weapons or the like for engaging in sumulated "combat" and "battles" with another like toy. As will be further described, preferred features of the construction facilitate these types of play activities.

As shown in FIG. 1, the present toy construction 10 comprises a molded humanoid torso portion 12 which is preferably formed from suitable moldable plastic material. In the preferred form, the toy FIG. 10 includes a head portion 14 integral with the torso portion 12, wherein the head portion is preferably generally configured in a human-like manner as will be further described.

In order to promote versatile play by children with the present toy construction, it is presently contemplated that a single combined torso portion 12/head portion 14 be configured for interchangeable use with differently configured human-like limb portions. To this end, torso portion 12 includes a pair of arm connecting socket-like portions 16 to which a pair of human-like arms 18 (shown in phantom line) can be respectively interchangeably connected. Similarly, torso 12 includes a pair of socket-like leg connecting portions 20 for respectively receiving human-like leg portions 22. In accordance with the adventure-oriented nature of the present action figure, limb portions such as 18 and 22 may be configured to resemble body-protecting armor, and further may be configured to include integral mock weapons, shields, and the like.

Figure 2:
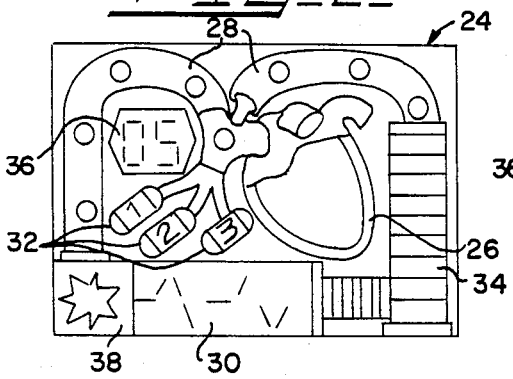
FIGS. 2–4 illustrate in detail the graphics display of the toy construction shown in FIG. 1, and shown the simulated life functions provided by the graphics display.
Figure 3:
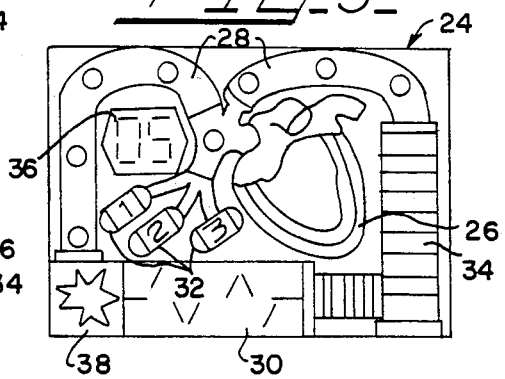
Figure 4:
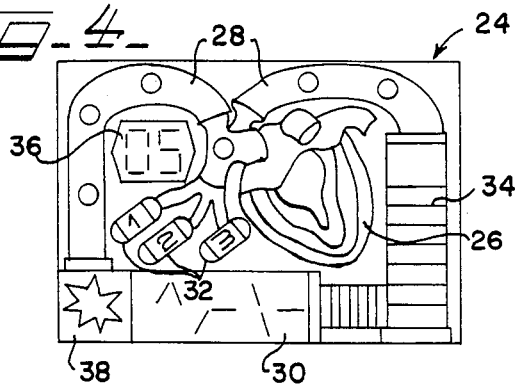

With further reference to FIG. 1, and with particular reference to FIGS. 2–4, the present action figure toy construction includes a graphics display 24 prominently mounted on torso portion 12. It is presently preferred that the graphics display 24 comprise a plurality of arrays of sequentially operable liquid crystal elements, whereby selective actuation of the graphics display provides a plurality of simulated life functions. As shown, it is contemplated that the graphics display be configured to include a "beating" heart 26, and circulating "blood" passages 28. The particular configuration of the graphics display 24 can, of course, be varied in keeping with the principles disclosed herein, but it is further contemplated that the display include a graphic display 30 of the action figure's activity level, and suitable indicia such as 32 to further represent the level of activity. Further, it is contemplated that graphics display 24 include a graphic representation 34 of the "energy level" of the action figure.

Thus, it will be appreciated that graphics display 24 is configured to provide the desired simulated life functions. Further, it is contemplated that the simulated life functions can operate at varying rates commensurate with a particular level or mode of activity of the action figure toy. For example, it is contemplated that variations in the graphics display correspond to the action figure being in a "rest" mode, a "fighting" mode, and the like. To this end, the controls for the graphics display are preferably programmed such that the action figure "consumes energy" at varying rates commensurate with its level or mode or activity. As will be appreciated, these types of features greatly enhance the entertainment of the action figure construction for children.

In further keeping with the concept of providing the present action figure toy with simulated life functions, the graphics display 24 is preferably configured to include a numerical display 36. The numerical display is preferably operatively connected with suitable timer circuitry within the associated micro-processor controls which provides an electrical timer signal reflecting the passage of time. In this manner, the "age" of the action figure can be shown on display 36. For example, suitable timer controls can be provided whereby the action figure "ages" one unit per week. Additionally, the timer circuitry can be arranged to alter the rate of the various life functions shown by the graphics display 24, thus representing "aging" of the action figure. Again, these features desirably enhance the entertainment value of the toy construction.

It is further contemplated that graphics display 24 be provided with an "explosion" or target indicator display 38. As will be further described, target display 38 is preferably arranged for activation in response to a "hit" scored by an "opponent" in mock combat with the toy construction.

Figure 5:
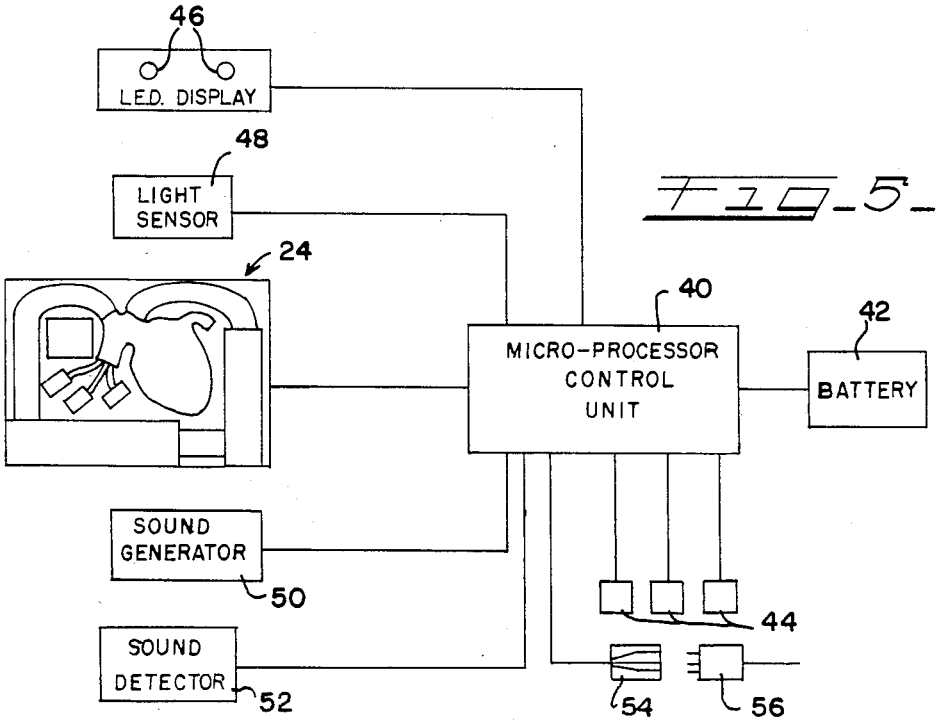
FIG. 5 is a diagrammatic view illustrating micro-processor control means, and related control devices for regulation and control of the graphics display of the present action figure.

As noted, suitable micro-processor controls are provided for effecting control and regulation of the graphics display 24. Accordingly, FIG. 5 shows micro-processor 40 operatively connected with graphics display 24. A suitable power source 42 is operatively connected with the micro-processor 40 for driving the processor and the associated graphics display; while a suitable battery is presently contemplated, it will be appreciated that the relatively low power consumption of the contemplated micro-processor and liquid crystal display 24 would permit operation by suitable solar cell power means.

At least one, and preferably a plurality of selectively operable switches 40 are operatively connected with the micro-processor 40, and are preferably positioned on torso portion 12 so that a child can operate the action figure in its different levels of activity. While manually operable switches are presently contemplated, it will be further recognized that one or more voice-activated or light-activated switches may also be employed.

Additional features of the present action figure toy construction are intended to further lend animated characteristics to the toy. In the preferred form, a pair of light-emitting diodes 46 are mounted in the head portion 14 of the toy construction to simulate "eyes" for the action figure. The diodes 46 are operatively connected to the micro-processor 40, with changes in the diodes, such as flashing or the like, being effected in coordination with changes in the plurality of levels of activity shown by the graphics display 24.

In the preferred form, the action figure is provided with a light sensor 48, preferably mounted in head portion 14, with the light sensor being operatively connected to micro-processor 40. It is presently contemplated that the light sensor 48 be responsive to predetermined light signals, with such light signals intended to be generated by a mock "laser beam" weapon of a like action toy figure. Further, the micro-processor 40 is arranged such that activation of light sensor 46 by the predetermined light signals acts to operate target indicator 38 of graphics display 24, thus visually indicating that a "hit" has been made upon the action figure by the opponent's mock weapon.

The present toy construction further preferably includes a sound generator 50, which may comprise a suitable piezo transducer, with sound generator 50 operatively connected with micro-processor 40. Sound generator 50 is preferably operated in coordination with operation of the different liquid crystal elements of graphics display 24. For example, suitable sounds are preferably generated attendant to manipulation of switches 44 for altering the level or mode of activity of the action figure. Further, a suitable sound is preferably generated attendant to activation of light sensor 48 in coordination with operation of target indicator display 38.

Additional features of the present action figure toy construction further enhance its entertainment value. If desired, a sound detector 52 can be provided in the action figure, with the sound detector operatively connected with mirco-processor 40. The sound detector is arranged to initiate one or more particular levels or modes of activity attendant to voice-actuation or the like.

As noted, many action figure toy constructions of the present type comprise but one of a series of related action figure toys and accessories such as vehicles, mock weapons, and the like. To this end, it is presently preferred that the toy construction include an accessory electrical coupling 54 operatively connected with micro-processor 40, with the coupling 54 being suitable for connection to an associated accessory plug 56 such as may be provided on an accessory vehicle or mock weapon. In this manner, particular and selected functions shown by the graphics display 24 can be operated in coordination with operation of the associated accessory.

Thus, an action figure toy construction has been disclosed which has been particularly configured to exhibit simulated life functions by the provision of a liquid crystal graphics display configured to show a plurality of levels or modes of activity for the action figure. While a presently contemplated form of the action figure toy construction has been disclosed herein, it will be appreciated that a wide variety of different toy figure constructions can be configured in accordance with the principles disclosed herein.

From the foregoing, it will be observed that numerous modifications and variations can be effected without departing from the true spirit and scope of the novel concept of the present invention. It is to be understood that no limitation with respect to the specific embodiment is intended or should be inferred. It is, of course, intended to cover by the appended claims all such modifications as fall within the scope of the claims.

We claim:

1. An action figure toy construction having animated characteristics, comprising:

a humanoid torso portion for said action figure construction configured to resemble a human torso;

graphics display means mounted on said torso portion and comprising a liquid crystal graphics display, said graphics display means being configured to display a plurality of simulated life functions and being operable to correspond to a plurality of varying levels of activity for said action figure construction to lend animated characteristics to said construction, said levels of activity including modes wherein said graphics display means reflects differing activities for said action figure toy construction, with the rate at which the features of said graphics display means are operated varying commensurate with the mode of the graphics display means;

micro-processor means operatively connected to said graphics display means for effecting operation and control thereof, including variations in said plurality of levels of activity of said simulated life functions displayed by said graphics display means;

at least one switch means on said torso portion, said switch means being operatively connected to said micro-processor means whereby operation of said switch means effects alteration of the simulated life functions shown by said graphics display means; and light sensor means operatively connected to said micro-processor means for receiving light signals, said graphics display means including target indicator means operated in response to said light-sensor means receiving predetermined light signals.

2. An action figure toy construction in accordance with claim 1, including a humanoid head portion joined to said torso portion of said action figure construction and, a pair of light-emitting means positioned in said head portion to represent eyes for said action figure construction, said light-emitting means being operatively connected with said micro-processor means for operation of said light-emitting means in coordination with changes in said simulated life functions shown by said graphics display means.

3. An action figure toy construction in accordance with claim 1, including sound detector means operatively connected to said micro-processor means for operating said graphics display means responsively to sound signals received by said sound detector means.

4. An action figure toy construction in accordance with claim 1, including sound generator means operatively connected to said micro-processor means for generation of sound in coordination with operation of said graphics display means displaying said simulated life functions.

5. An action figure toy construction in accordance with claim 1, wherein said torso portion includes means for interchangeably connecting humanoid limb portions to said torso portion.

6. An action figure toy construction in accordance with claim 1, wherein accessory electrical coupling means operatively connected to said micro-processor means for electrically coupling an associated accessory toy with said micro-processor means.

7. An action figure toy construction having animated characteristics, comprising:

a humanoid torso portion for said action figure construction configured to resemble a human torso, including a humanoid head portion joined to said torso portion;

liquid crystal graphics display means mounted on said torso portion, said graphics display means being configured to display a plurality of simulated life functions in a plurality of levels of activity for said action figure construction to lend animated characteristics thereto; said levels of activity including modes wherein said graphics display means reflects differing activities for said action figure toy construction, with the rate at which the features of said graphics display means are operated varying commensurate with the mode of the graphics display means, said graphics display means including means displaying an energy level for said action figure toy construction which reflects energy consumption at a rate commensurate with the mode of said graphics display means;

micro-processor means operatively connected to said graphics display means for effecting operation and control thereof, including variations in said plurality of levels of activity of said simulated life functions displayed by said graphics display means;

at least one switch means on said torso portion, said switch means being operatively connected to said micro-processor means whereby operation of said switch means effects operation of said graphics display means;

light-emitting diode means positioned in said head portion to represent eyes for said action figure, said light-emitting diode means being operatively connected with said micro-processor means for operation of said light-emitting diode means in coordination with changes in the simulated life functions shown by said graphics display means;

light-sensor means operatively connected to said micro-processor means for operating said graphics display means responsively to light signals received by said light sensor means; and sound generator means operatively connected to said micro-processor means for generation of sound in coordination with said simulated life function shown by said graphics display means.

8. An action figure toy construction in accordance with claim 7, wherein said micro-processor means includes timer means for generating an electrical timer signal reflecting the passage of time, said graphics display means including a numerical display operatively connected with said timer means for displaying changing numerals reflecting passage of time to provide a display of the age of said action figure toy construction.

9. An action figure toy construction having animated characteristics, comprising:

a humanoid torso portion for said action figure construction configured to resemble a human torso;

graphics display means mounted on said torso portion and comprising a liquid crystal graphics display, said graphics display means being configured to display a plurality of simulated life functions and being operable to correspond to a plurality of varying levels of activity for said action figure construction to lend animated characteristics to said construction, said levels of activity including modes wherein said graphics display means reflects differing activities for said action figure toy construction, with the rate at which the features of said graphics display means are operated varying commensurate with the mode of the graphics display means;

micro-processor means operatively connected to said graphics display means for effecting operation and control thereof, including variations in said plurality of levels of activity of said simulated life functions displayed by said graphics display means; and at least one switch means on said torso portion, said switch means being operatively connected to said micro-processor means whereby operation of said switch means effects alteration of the simulated life functions shown by said graphics display means, said micro-processor means including timer means for generating an electrical timer signal reflecting the passage of time, said graphics display means including a numerical display operatively connected with said timer means for displaying changing numerals reflecting passage of time to provide a display of the age of said action figure toy construction.

10. An action figure toy construction having animated characteristics, comprising:

a humanoid torso portion for said action figure construction configured to resemble a human torso;

graphics display means mounted on said torso portion and comprising a liquid crystal graphics display, said graphics display means being configured to display a plurality of simulated life functions and being operable to correspond to a plurality of varying levels of activity for said action figure construction to lend animated characteristics to said construction, said levels of activity including modes wherein said graphics display means reflects differing activities for said action figure toy construction, with the rate at which the features of said graphics display means are operated varying commensurate with the mode of the graphics display means;

micro-processor means operatively connected to said graphics display means for effecting operation and control thereof, including variations in said plurality of levels of activity of said simulated life functions displayed by said graphics display means; and at least one switch means on said torso portion, said switch means being operatively connected to said micro-processor means whereby operation of said switch means effects alteration of the simulated life functions shown by said graphics display means, said micro-processor means including timer means for generating an electrical timer signal reflecting the passage of time, said time signal being provided to alter the rate of said simulated life functions shown by said graphics display means to represent aging of said action figure toy construction.

* * * * *